United States Patent [19]

Rose

[11] 4,221,431

[45] Sep. 9, 1980

[54] NOVELTY CHAIR

[76] Inventor: Charles F. Rose, 7058 Lynwood Way, Sacramento, Calif. 95828

[21] Appl. No.: 858,008

[22] Filed: Dec. 6, 1977

[51] Int. Cl.[2] ..... A47C 1/12

[52] U.S. Cl. ..... 297/445; 297/1; D6/12; D6/68; 4/661

[58] Field of Search ..... D6/12, 68; 4/134; 297/445, 1

[56] References Cited

U.S. PATENT DOCUMENTS

| | | | |
|---|---|---|---|
| 1,557,919 | 10/1925 | Zundel | 4/134 |
| 1,691,620 | 11/1928 | Wilson | 4/134 |
| 2,307,897 | 1/1943 | Overholser | 4/134 |
| 3,343,179 | 9/1967 | Sellars et al. | 4/134 |
| 3,392,411 | 7/1968 | Hansen | 4/134 |
| 3,611,449 | 10/1971 | Berry | 4/134 |
| 3,716,872 | 2/1973 | Zieman | 4/134 |

*Primary Examiner*—James C. Mitchell
*Attorney, Agent, or Firm*—Mark C. Jacobs

[57] ABSTRACT

A novelty chair simulating a conventional water closet having a cushioned seat and backrest. Support arms may be provided and the chair may be mounted on a base for better stability. The chair may also be rotatably mounted on the base.

12 Claims, 5 Drawing Figures

NOVELTY CHAIR

BACKGROUND OF THE INVENTION

1. Field of the Invention

The invention relates to novelty chairs; and, more particularly, to a chair which simulates a conventional water closet buts acts as a conversational piece in that a comfortable chair is provided.

2. Description of the Prior Art

Various types of chairs are known in the art. Many such chairs simulate items that are other than chairs, or are made from unconventional items, such as whiskey barrels. With the emphasis today on contemporary furniture and a more relaxed style of living, there is a need for novelty furniture that are conversation pieces in the proper environment. Such novelty furniture should be quickly and easily identifiable and amusing, yet simultaneously function as an article of furniture. Also, with today's emphasis on ecology and finding new uses for items normally discarded, there is a need for converting no longer needed water closets to fine pieces of furniture.

SUMMARY OF THE INVENTION

It is an object of this invention to provide a novelty chair which simulates a conventional water closet but is fully functional as a comfortable chair.

It is a further object of this invention to provide such a novelty chair which is easily built from a conventional water closet.

It is still another object of this invention to provide such a novelty chair which is comfortable and amusing to view.

These and other objects are preferably accomplished by providing a chair which simulates a conventional water closet having a cushioned seat and backrest. Support arms may be provided and the chair may be mounted on a base for better stability. The chair may also be rotatably mounted on the base.

DESCRIPTION OF THE PREFERRED EMBODIMENTS

Figure 1:
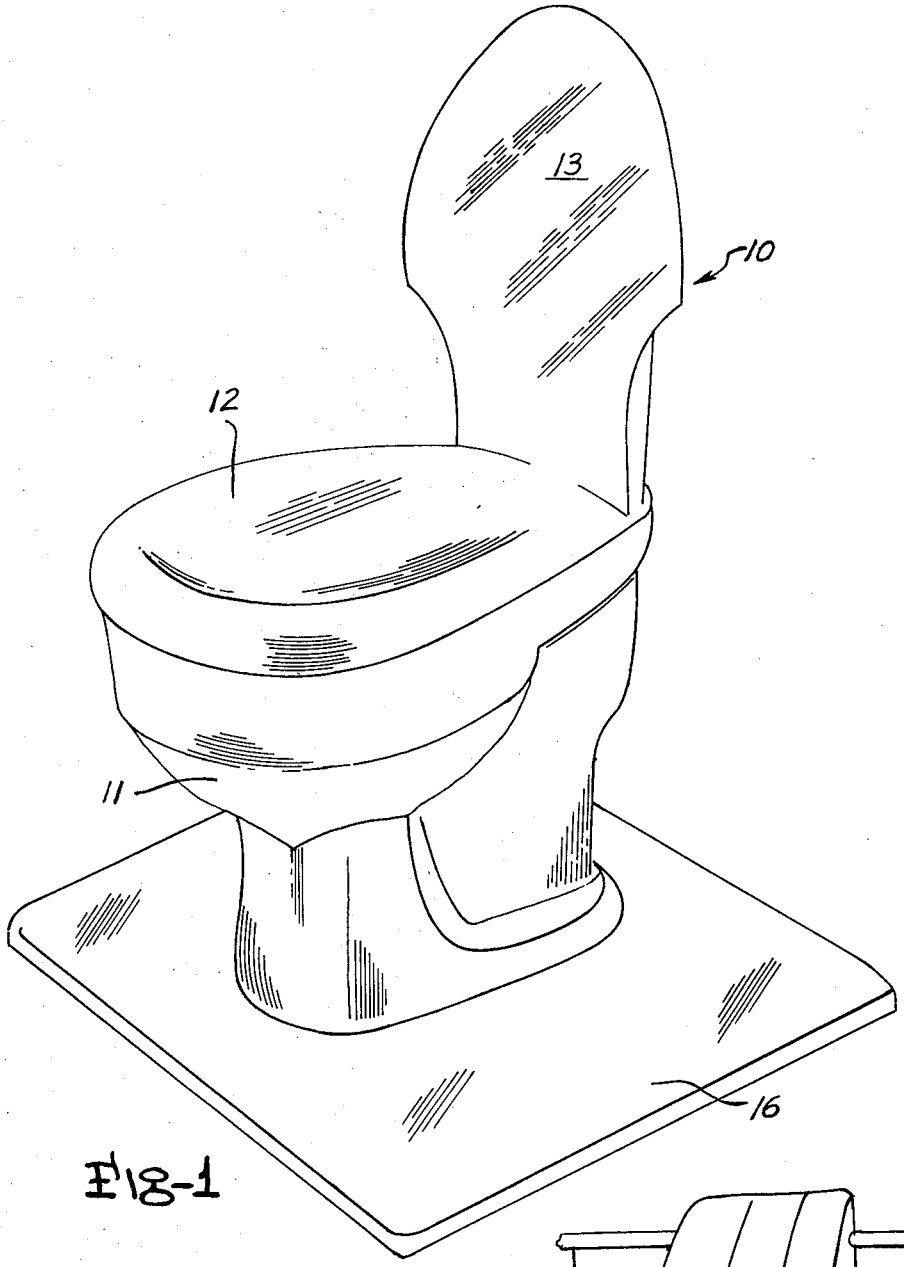
FIG. 1 is a perspective view of a novelty chair in accordance with the teachings of my invention.

Referring now to FIG. 1 of the drawing, a novelty chair 10 is shown having as a main support base a conventional water closet. Any suitable water closet may be converted into a chair in accordance with the teachings of my invention. Thus, as shown in FIG. 1, the seat 12 of chair 10 may be provided by covering the seat of the conventional water closet (which normally encircles the bowl portion) with foamed material. Of course, the hole in the conventional seat would have to be reinforced. Any suitable foamed material, such as polyurethane, may be used. This foamed material may then be covered with a suitable fabric, natural or synthetic leather, etc.

Of course, the conventional seat of the water closet may be removed and replaced with a seat having the outline of the upper lip of the bowl as seen in FIG. 1. In either case, the seat is cushioned and covered with suitable material as heretofore described.

Figure 2:
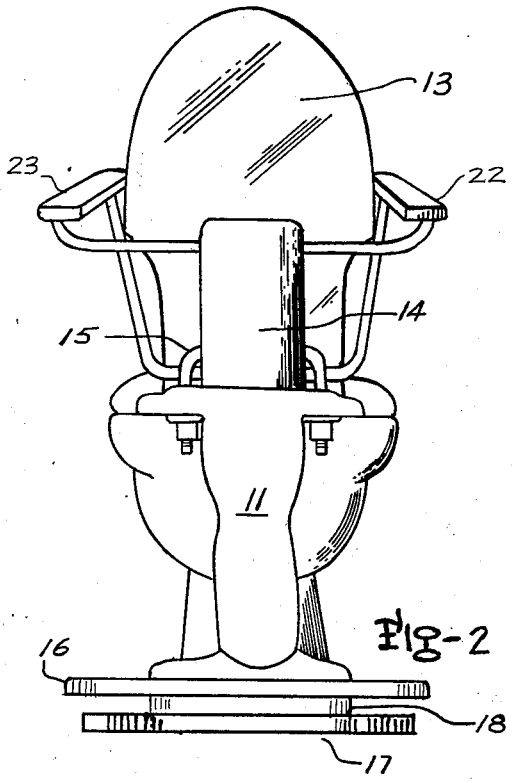
FIG. 2 is a rear view of the chair of FIG. 1.

A backrest 13 is provided for chair 10 simulating the raised lid of a conventional water closet. Generally, such conventional water closets have some sort of lid support means to hold or support the lid in an upright position. If not, such a support may be provided. For example, as seen in FIG. 2, a lid support 14 is provided which may be in the form of an angled block of suitable material, such as wood or the like, secured by suitable bolts 15 fixed to support 14 and water closet 11 as shown in FIG. 2. Of course, the particular water closet used to form the chair of my invention may already have such rear support as heretofore discussed.

The backrest 13 may of course be provided by either covering the lid of the conventional water closet with foamed or other suitable material, covered with fabric or the like as heretofore discussed. Alternatively, a seperate backrest may be provided as discussed hereinabove with regard to seat 12. Of course, in providing both seat 12 and backrest 13, the conventional securing means, such as bolts, apertures, etc. already present on the water closet may be used where possible.

The water closet main support base 11 may be fixedly mounted on a support, such as a rectangular or square-shaped base 16 of any suitable material for added stability. Such base 16 may be provided on the bottom with a revolving base 17, the particular means forming no part of my invention. For example, suitable conventional ball bearing means 18 may be provided beween bases 11 and 16 to carry out such rotation. Alternatively, such means 18 may be provided between base 16 and the bottom of base 11 so that the chair 10 revolves on base 16.

The backrest 13 may be pivotally mounted on the water closet 11 so that it can be folded down for storage. Pivot means for pivoting a lid of a water closet are well known in the art. Any suitable covering materials may be used for the seat and the backrest so that the chair can blend in with other articles of furniture. Bases 16 and 17 are optional but preferred for greater stability.

Figure 3:
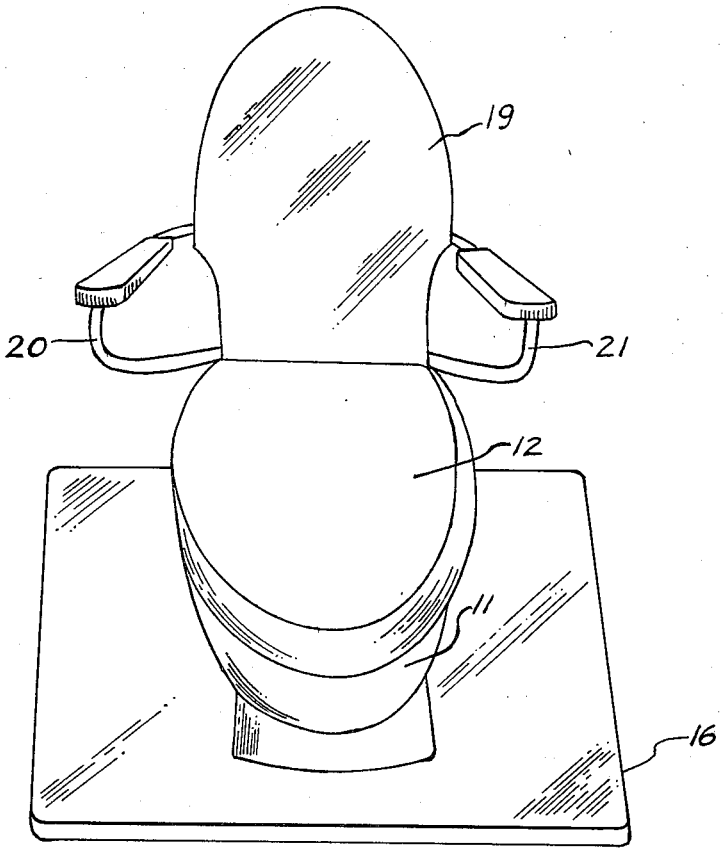
FIG. 3 is a perspective view of another novelty chair in accordance with the teachings of my invention.
Figure 4:
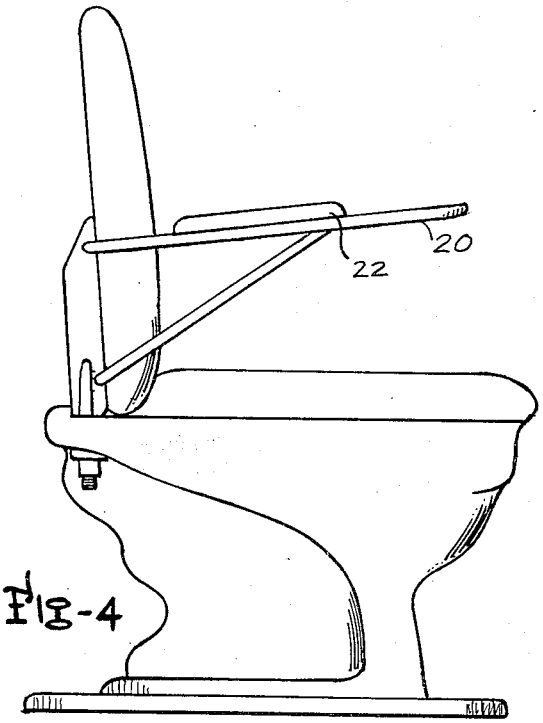
FIG. 4 is a side view of another embodiment of a novelty chair in accordance with this invention, wherein the attachment point of the arm support differs from the attachment point of the arm support on the arm as shown in the embodiment of FIG. 3.

Although backrest 13 is shown in particular in FIG. 1, it may take a variety of configurations such as the backrest 19 in FIG. 3. In FIG. 3, like numerals refer to like numerals of the chair of FIG. 1. However, in this embodiment, arm rests 20,21 are shown. These arm rests 20,21 may be formed of suitable materials, such as wrought iron, and may be bent or otherwise formed into various configurations. As shown in FIG. 4, each arm rest is generally triangular in shape. Arm rests 20,21 may be provided with arms 22,23, of wood or other suitable material, in any desired shape, length or configuration. Arms 22,23 may be padded or unpadded, left plain or otherwise match any desired part of the chair. Of course, such arm rests may also be provided on the chair of FIG. 1.

Figure 5:
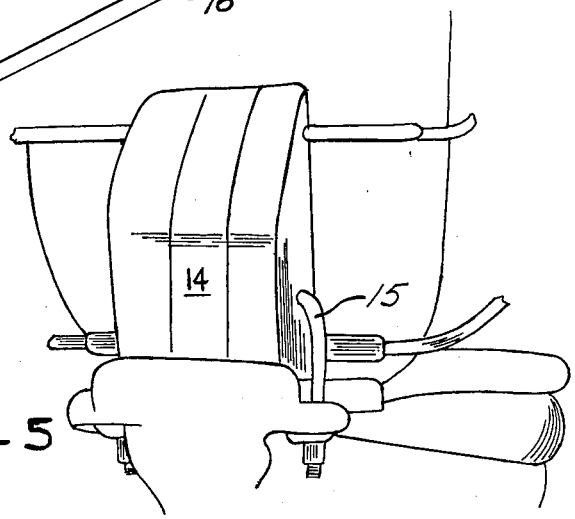
FIG. 5 is a rear perspective view partially in fragment of one embodiment of the chair of this invention.

As shown in FIG. 5, the arm rests 20,21 are secured to the chair of FIG. 3 by having portions passing through support 14 which portions may be reinforced for greater strength and rigidity, if desired.

Although arm rests 20,21 are shown unadorned, they may be provided with suitable scroll work, as for example, portions interconnecting the upper and lower portions of each arm rest as is known in the chair art.

It can be seen that I have disclosed a novelty chair easily and quickly formed from a conventional water closet that might otherwise be discarded. Any suitable water closet may be used and adapted as discussed herein. Although the seat and backrest may take various configurations, it is preferable to keep as close as possible to seats and lids of conventional water closets.

Any suitable materials may be used and the chair may be provided with arm rests, if desired.

Optionally, the trap may be sealed off by an appropriate sealing means such as a board cut to shape and then cemented in place such that the bowl 11 may be used for storage without the fear of losing articles down the trap.

Since certain changes may be made in the above apparatus without departing from the scope of the invention herein involved, it is intended that all matter contained in the above description are shown in the accompanying drawings shall be interpreted as illustrative and not in a limiting sense.

I claim:

1. A novelty chair comprising: a base, said base consisting of the main base of a conventional water closet and which includes a bowl portion, and a trap a cushioned seat covering said bowl portion simulating the conventional seat of the water closet, secured to said base said cushioned seat providing a generally inperforate support surface;

an upright cushioned backrest extending upwardly from the rear of said cushioned seat simulating the raised lid of a conventional water closet; and support means connected to said main base and to said backrest for supporting said backrest in its upright position.

2. In the chair of claim 1 wherein the main support base is fixedly mounted on a base greater in area extent than said main support base.

3. In the chair of claim 2 including rotary means associated with said chair for rotating said main base.

4. In the chair of claim 1 wherein said upright backrest is foldable to a position abutting against the upper surface of said seat.

5. In the chair of claim 1 wherein a pair of arm rests are coupled to said upright backrest, each of said arm rests extending from opposite sides of said backrest to opposite sides of said seat, and extending forwardly.

6. In the chair of claim 5 wherein each of said arm rests include a generally horizontal arm extending along at least a portion of each of said arm rests.

7. In the chair of claim 6 wherein each of said arm rests are of metallic material and fixed to said support means.

8. In the chair of claim 1 wherein both said seat and said backrest have an outer configuration simulating the seat and lid of a conventional water closet.

9. In the chair of claim 8 wherein both said seat and said backrest have an interior of foamed material covered on the outer surface by flexible cloth-like material.

10. In the chair of claim 1 wherein the trap is sealed off to create a storage compartment.

11. A novelty chair comprising:

a base, said base consisting of the main base of a conventional water closet and which includes a bowl portion and a trap portion; and a cushioned seat covering said bowl portion simulating the conventional seat of the water closet, secured to said base, said cushioned seat providing a generally imperforate support surface;

an upright cushioned backrest extending upwardly from the rear of said cushioned seat simulating the raised lid of a conventional water closet; and support means connected to said main base and to said backrest for supporting said backrest in its upright position, wherein the base is fixedly mounted on a base greater in area extent than said main support base; and a pair of arm rests are coupled to said upright backrest, each of said arm rests extending from opposite sides of said backrest to opposite sides of said seat, and extending forwardly, wherein both said seat and said backrest have an outer configuration simulating the seat and lid of a conventional water closet.

12. In the claim of claim 11, wherein the trap is sealed off to form a storage compartment.

* * * * *